US009149842B2

(12) United States Patent
Wolf

(10) Patent No.: US 9,149,842 B2
(45) Date of Patent: Oct. 6, 2015

(54) FINES CLASSIFIER

(71) Applicant: David J. Wolf, Johnson Creek, WI (US)

(72) Inventor: David J. Wolf, Johnson Creek, WI (US)

(73) Assignee: JWR, Inc., Johnson Creek, WI (US)

( * ) Notice: Subject to any disclaimer, the term of this patent is extended or adjusted under 35 U.S.C. 154(b) by 54 days.

(21) Appl. No.: 13/965,096

(22) Filed: Aug. 12, 2013

(65) Prior Publication Data

US 2015/0041373 A1 Feb. 12, 2015

(51) Int. Cl.
*B07B 4/02* (2006.01)

(52) U.S. Cl.
CPC .. *B07B 4/02* (2013.01); *B07B 4/025* (2013.01)

(58) Field of Classification Search
CPC ..... B03B 4/02; B03B 11/06; B03B 7/01; B03B 7/04; B07B 4/025
USPC ..... 209/134, 135, 136, 137
See application file for complete search history.

(56) References Cited

U.S. PATENT DOCUMENTS

| | | | | |
|---|---|---|---|---|
| 2,978,103 | A * | 4/1961 | Cowher, Sr. | 209/135 |
| 3,856,217 | A * | 12/1974 | Brewer | 241/79.1 |
| 5,400,908 | A * | 3/1995 | Prestwood | 209/25 |
| 5,967,333 | A * | 10/1999 | Smith | 209/135 |
| 6,089,378 | A * | 7/2000 | Mascheretti et al. | 209/143 |
| 8,307,987 | B2 * | 11/2012 | Miller et al. | 209/139.1 |

* cited by examiner

*Primary Examiner* — Jeremy R Severson
(74) *Attorney, Agent, or Firm* — Whyte Hirschboeck Dudek S.C.

(57) ABSTRACT

A system and method for classification of materials employing a material fall path that is intersected by an air flow path, a first materials output located below the material fall path and a second materials output located distally of the first materials output.

14 Claims, 3 Drawing Sheets

FINES CLASSIFIER

FIELD OF THE INVENTION

The present invention relates to systems and methods for the separation of mixed materials.

BACKGROUND OF THE INVENTION

The ability to efficiently separate mixed materials, such as household recycling and construction waste, is of increasing importance and economic significance. For example, efficiently extracting and separating various types of recyclable materials from variable mixed waste streams is a critical factor when considering the economic viability of a recycling program. Material Recovery Facilities (MRFs) must be able to separate or sort mixed recyclable materials to a significantly high purity, for example 10 percent. If the final sorted and bailed product, for example similar plastic materials, does not achieve the purity required for purchase on the commodity market at a desired price, the product represents wasted resources and a financial loss for the MRF.

One step in the sorting or separation process is the dimensional sorting of materials. Dimensional separators employ various separation techniques to separate relatively light materials, for example, two-dimensional materials such as fibers, films; relatively heavier three-dimensional materials such as plastic, metal and certain large dimensional fibers; and materials of a relatively small dimension or fines, for example, crushed glass, shredded paper, and certain organic materials from one another. The small materials or fines are typically separated by providing voids or holes in a surface over which the various materials are separated. The fines pass through the surface and ultimately into a vessel or onto a conveyor belt for transfer.

It is relatively common that the fines resulting from such separation techniques contain a mixture of crushed glass and shredded paper. In order to achieve the desired purity of separated or classified material, it is necessary to further sort the resulting fine to separate the crushed glass from the shredded paper. Various techniques have been employed to achieve this stage of separation. For example, some Material Recovery Facilities (MRFs) employ a manual classification of the fines. Manual separation has the obvious shortcoming of being relatively inefficient and slow and relatively costly due to the need for increased employees.

Another type of fines classification employs trammel or drum separation techniques. Trammel classifiers use a generally horizontally oriented, hollow cylinder having corkscrew-like ribs or fins arranged on an interior surface. In operation, these classifiers separate fines by depositing the materials for separation into the interior of the cylinder and rotating the cylinder. The walls of the cylinder may have holes through which the smaller, heavier materials fall while the lighter materials such as fibers are carried or pushed by the rotating ribs to an opposite end of the cylinder. Trammel-type classifiers have the disadvantage of being relatively costly, occupying a relatively large amount of space in the MRF, and requiring relatively high maintenance due to the various rotating components and relatively high amount of dust and air born materials generated by the movement of the materials for separation within the cylinder.

Yet another technique for classifying fines employs optical recognition technology to identify certain types of fines materials and, upon identification, uses blowers, magnets or other removal means to extract the identified materials from the remainder of the fines. These classifiers have the disadvantage of being relatively costly, requiring relatively highly technically trained personnel to operate and maintain the complex optical hardware and software, and requiring relatively high maintenance costs of the components for extraction of the materials optically identified.

In view of the above described shortcomings of the known fines classifiers, there exists a significant need in the art for a fines classifier that employs a more efficient separation or classification technique requiring fewer moving components; a smaller footprint in the MRF, and decreased initial, maintenance, and repair costs.

OBJECTS AND SUMMARY OF THE INVENTION

The present invention provides a robust fines classifier that employs a more efficient classification technique that requires fewer moving components; a smaller footprint in the MRF, and decreased initial, maintenance, and repair costs. These objectives are achieved by providing a materials classifier having a material fall path; an air flow path that intersects the material fall path; a first output located beneath the material fall path; and a second output located distally of the first output along the air flow path.

In another embodiment of the present invention, these objectives are achieved by providing a materials classifier employing a housing having a proximal end and a distal end; a conveyor belt located within the housing and positioned over a portion of a first materials output; and a blower located at a proximal end of the housing that blows air within the housing from the proximal end of the housing towards the distal end of the housing; and a second materials output located at a proximal end of the housing.

In certain embodiments of the fines classifier of the present invention, a material deflector is employed to confine the fall of the materials for separation within a defined fall path or zone. In certain other embodiments of the fines classifier of the present invention, an air deflector is employed to direct an air flow within a defined air flow path.

These objectives are also achieved by a method of the present invention including the steps of allowing materials for separation to fall from an elevated surface formed within a housing; generating an air flow path that intersects the materials falling from the elevated surface; and separating a portion of the materials for separation that fall through the air flow path from a portion of the materials that are carried along a portion of the air flow path.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
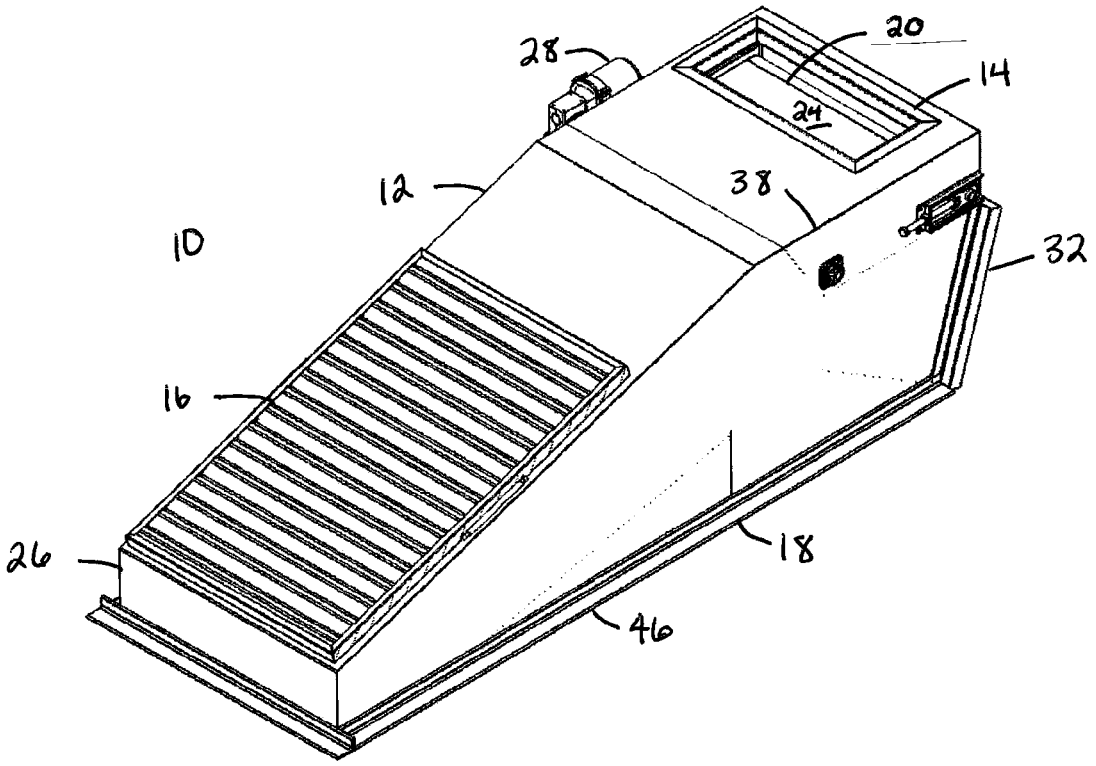
FIG. 1 is a perspective view of a fines classifier according to one embodiment of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The present invention provides a robust, economical to operate, and economical to maintain fines classifier for the separation of materials of relatively small dimension or fines, for example, crushed glass and shredded paper or other fiber products. Broadly speaking, unclassified fines enter the classifier of the present invention and are directed to fall through a controlled air flow path. The heavier materials such as crushed glass drop through the air flow path and are received in a first output. The relatively lighter materials are carried or pushed by the air path horizontally away from the fall path of the heavier materials into a second output separate from the first output.

More particularly, with reference to FIGS. 1-4, a classifier 10 according to the present invention includes a housing 12 formed upon a frame 18. The frame 18 is formed in the general shape of a rectangle. The housing 12 is formed upon the frame 18 and has a generally wedge-like shape. A proximal side 32 of the housing 12 has a greater height than a distal side 26 of the housing 12. By way of example, the classifier 10 may have a length of approximately six to 10 feet or approximately 8 feet; may have a width of approximately 24 to 72 inches or approximately 48 inches; and may have a height at the proximal side 32 of approximately 24 to 48 inches or approximately 35 inches.

Figure 2:
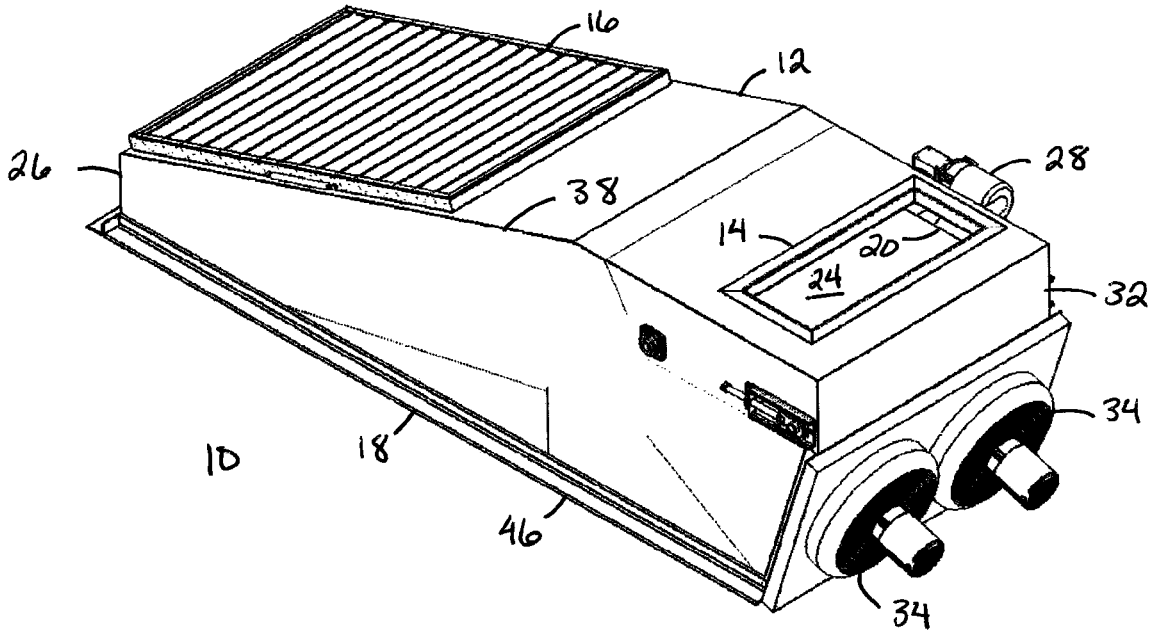
FIG. 2 is a perspective view of a fines classifier according to one embodiment of the present invention.
Figure 5:
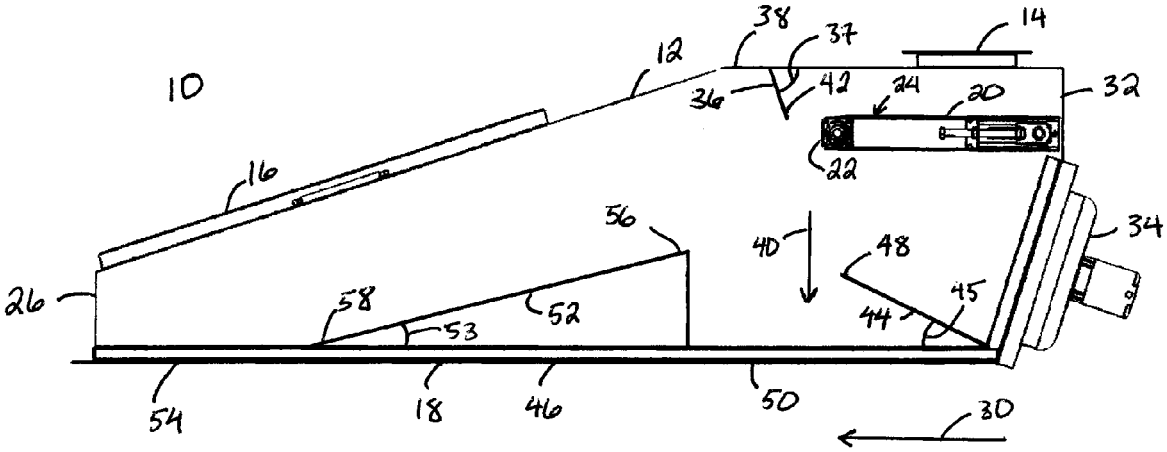
FIG. 5 is a partial cut-away, elevation view of a fines classifier according to one embodiment of the present invention.
Figure 6:
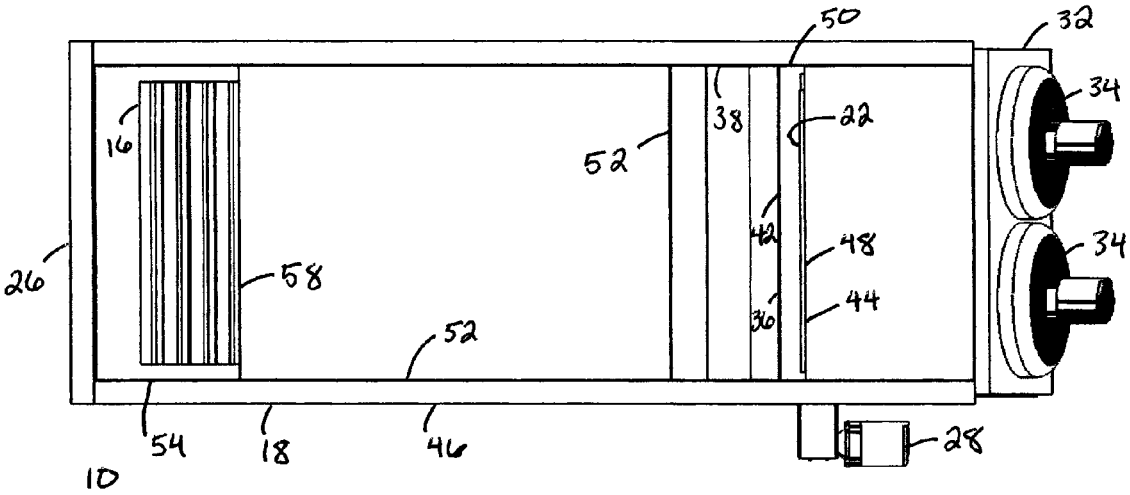
FIG. 6 is a plan view of an underside of a fines classifier according to one embodiment of the present invention.

Formed within the top portion 38 of the housing 12 near the side 26 of the housing 12 is a vent 16. Formed within a top portion 38 of the housing 12 near the side 32 of the housing 12 is an input 14. The input port 14 functions to receive materials for separation and is located over a conveyor belt 20. A top surface 24 of the conveyor belt 20 moves in the direction of arrow 30, shown in FIGS. 4 and 5, towards the side 26 of the housing 12. A motor 28 drives the motion of the conveyor belt 20. In certain embodiments, the motor 28 is located outside of the housing 12, as shown in FIGS. 1, 2, and 6. This feature is advantageous in that it partially isolates the motor 28 from exposure and contamination by the materials being separated within the classifier 10. It also allows for easier access to the motor 28 for maintenance and repair.

In certain embodiments, instead of the conveyor belt 20, the classifier 10 of the present invention employs a sloped surface upon which materials for separation are received through the input 14. As materials are deposited upon the sloped surface, the materials slide in the general direction of arrow 30 toward a lower side of the sloped surface located in a position analogous to the side 22 of the conveyor belt.

Figure 3:
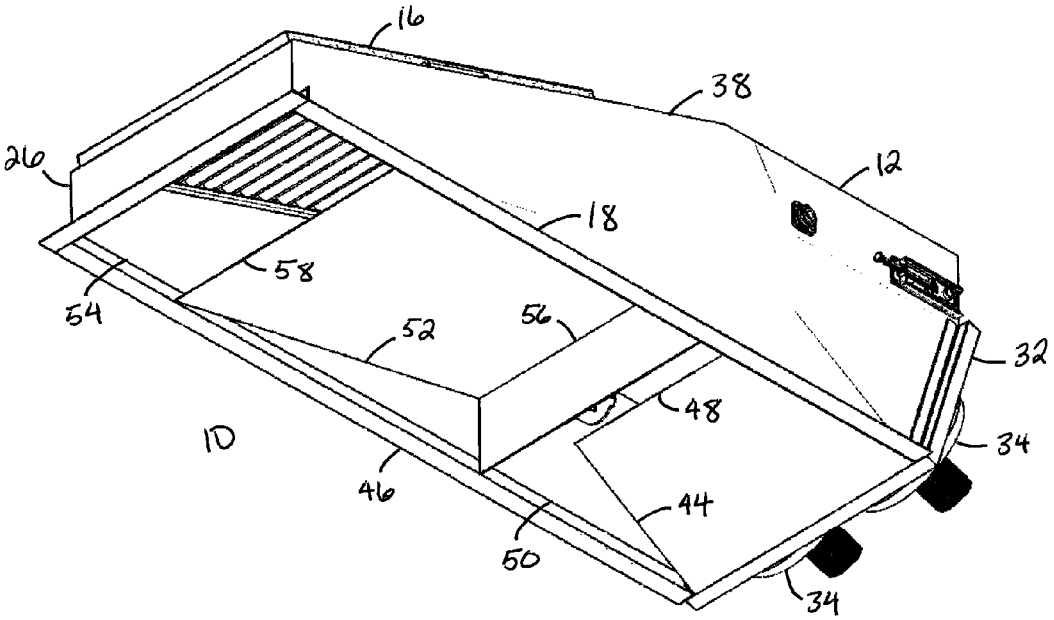
FIG. 3 is a perspective view of a fines classifier according to one embodiment of the present invention.
Figure 4:
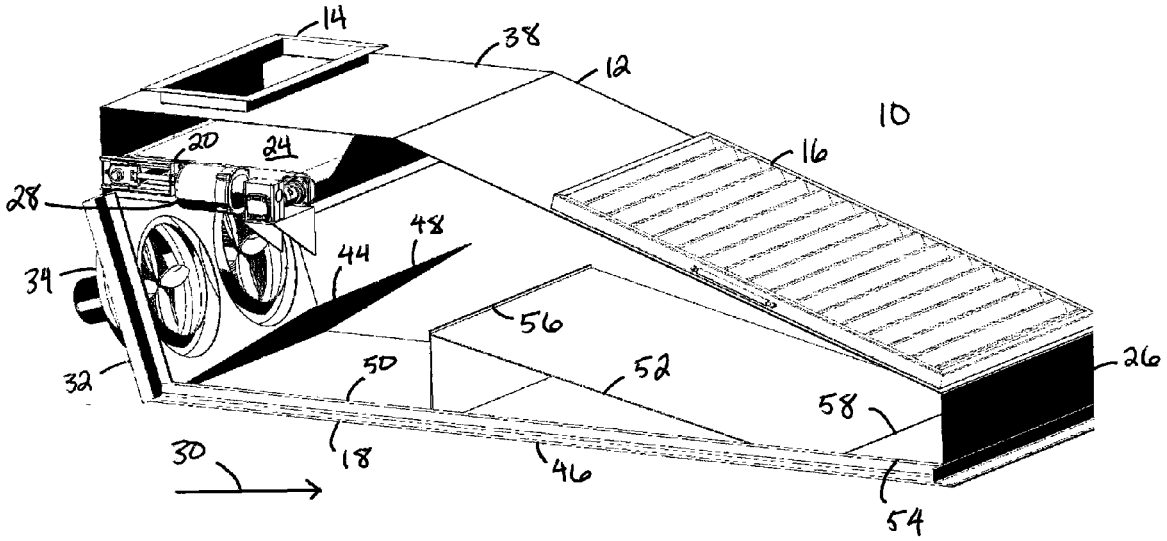
FIG. 4 is a partial cut-away, perspective view of a fines classifier according to one embodiment of the present invention.

As shown in FIGS. 3-6, also located within an interior of the housing 12 is a materials deflector 36 that extends downward from the top portion 38 of the housing 12. The materials deflector 36 functions to direct or confine the materials being separated such that the materials for separation drop from the side 22 of the conveyor belt 20 in a direction of arrow 40, shown in FIG. 5, within a specific material fall path or zone. The materials deflector 36 may form an angle 37 relative to the top portion 38 of the housing 12. The angle 37 may, for example, be in the range of approximately 40 degrees to 80 degrees, approximately 60 to 65 degrees, or approximately 58 degrees. The material fall path is generally defined by a zone extending vertically from the top portion 38 of the housing 12 to a first output 50 formed in a lower portion 46 of the frame 18 and bordered on a distal side by a side 42 of the materials deflector 36 and on a proximal side by the side 22 of the conveyor belt 20. As shown in FIGS. 3 and 6, the housing 12 does not extend over or otherwise cover an underside of the classifier 10. Accordingly, the first output 50 servers as an exit point for certain types of materials classified within the classifier 10.

Located in the side 32 of the housing 12 are one or more blowers 34. The blowers 34 pull air from outside of housing 12 and blow the air within the housing 12 thereby creating air flow through an air flow path from the blowers 34 in the general direction of the arrow 30 towards the distal side 26 of the housing 12. A portion of the air flow of the air flow path exits the housing 12 through the vent 16. The blower or blowers 34 may, for example, may generate an air flow of up to approximately 5,900 cubic feet per minute.

Also located within the interior of the housing 12, below the conveyor belt 20 is an air deflector 44. The air deflector 44 extends upwards and distally from the lower portion 46 of the frame 18. An end 48 of the deflector 44 extends from below the blowers 34 generally towards the distal side 26 of the housing 12. As shown in FIGS. 5 and 6, the end 48 of the air deflector 44 does not extend towards the side 26 of the housing 12 as far as the side 22 of the conveyor belt 20 extends towards the side 26 of the housing 12. Stated alternatively, the end 48 of the air deflector 44 is located under the conveyor belt 20 short of the side 22 of the conveyor belt 20 such that material falling down the material fall path does not fall onto the air deflector 44. The air deflector 44 may form an angle 45 relative to the lower portion 46 of the frame 18. The angle 45 may, for example, be in the range of approximately 20 degrees to 40 degrees, approximately 28 to 36 degrees, or approximately 31.5 degrees.

Also located within the housing 12 is a ramp 52 that separates the first output 50 from a second output 54 that is located near the distal side 26 of the housing 12. A side 56 of the ramp 52 is elevated above a side 58 of the ramp 52 so as to provide a surface that slopes downward towards the second output 54. The ramp 52 may form an angle 53 relative to the lower portion 46 of the frame 18. The angle 53 may, for example, be in the range of approximately 6 degrees to 20 degrees, approximately 9 to 16 degrees, or approximately 12.8 degrees.

In certain embodiments of the present invention, the classifier 10 is positioned upon a structure that allows for the placement and exchange of receptacles or material transport components, such as conveyor belts, below the first output 50 and second output 54.

In operation, materials of relatively small dimension or fines are deposited through the input 14 onto conveyor belt 20. Rotation of the conveyor belt 20 carries the materials towards side 22 of the conveyor belt 20. As the materials fall from side 22 of the conveyor belt 20 they pass through the air flow of the air flow path generated by blowers 34 that is directed upward relative to the horizontal surface of the lower portion 46 of the frame 18 by air deflector 44. The relatively heavier portion of the fines, such as crushed glass, is relatively unaffected by the air flow of the air flow path generated by blowers 34 and falls from the conveyor belt 20 directly through the first output 50. The relatively heavier materials are then directly captured in a receptacle or are transported to another location by a conveyor belt, slide, or other manner of transporting such materials.

The relatively lighter materials falling from the side 22 of the conveyor belt 20, such as shredded paper and other fibers, are carried or pushed by the air flow of the air flow path generated by blowers 34 in the direction of arrow 30. The lighter portion of the materials are either blown directly to the side 26 of the housing and thereafter fall through the second output 54 or are blown onto the ramp 52 and slide down and off of the ramp 52 and thereafter fall through the second output 54. The vent 16 allows for escape of the air blown through the air flow path at the side 26 of the housing 12.

The fines classifier 10 according to the present invention provides significant advantages over known fines classifiers. For example, the classifier 10 of the present invention is operable to separate materials to high levels of purity by employing relatively few components. Due to the presence of fewer components that are prone to wear, that are exposed to falling fines, and that require calibration, the classifier of the present invention requires less maintenance and thereby achieves lower operating cost relative to known classifiers.

The fines classifier 10 according to the present invention provides significant cost advantages as its design allows for a relatively economical manufacturing of the classifier in comparison to complex, large, structures and moving components of known trammel-type classifiers and the complex and expensive optical hardware and software components required in optical classifiers.

Furthermore, fines classifier 10 according to the present invention advantageously employs a relatively compact structure. Accordingly, MRF's may more easily incorporate the present classifier within the confines of existing material separation lines and at multiple locations within with material separation lines, if so desired.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A materials classifier comprising:

a wedge shaped housing having a top portion;

an input port for receiving materials situated along the top portion;

a vent situated along the top portion;

a material fall path;

a conveyor belt located within the housing and a motor driving the conveyor belt located outside of the housing;

a first output located beneath the material fall path; and an air flow path that intersects the material fall path, wherein the air flow path includes exiting the housing through both the vent and a second output located distally of the first output.

2. The materials classifier of claim 1 further comprising a materials deflector extending from a top portion of an interior of the housing, wherein the materials deflector extends at least at a 45 degree angle relative to the top portion of the interior of the housing.

3. The materials classifier of claim 2, wherein the material deflector extends from the top portion in a direction towards the input port of the housing and away from the Output port.

4. The materials classifier of claim 1 wherein the conveyor belt is located beneath the input port.

5. The materials classifier of claim 4, wherein the conveyor belt is situated parallel to the bottom of the housing.

6. The materials classifier of claim 1 further comprising a blower.

7. The materials classifier of claim 1 further comprising an air deflector that directs the air flow of the air flow path.

8. A materials classifier comprising:

a wedge shaped housing having a top portion;

an input port for receiving materials situated along the top portion;

a vent situated along the top portion;

a material fall path;

a conveyor belt located beneath the input port;

a first output located beneath the material fall path; and an air flow path that intersects the material fall path, wherein the air flow path includes exiting the housing through both the vent and a second output located distally of the first output.

9. The materials classifier of claim 8 further comprising a materials deflector extending from a top portion of an interior of the housing, wherein the materials deflector extends at least at a 45 degree angle relative to the top portion of the interior of the housing.

10. The materials classifier of claim 9, wherein the material deflector extends from the top portion in a direction towards the input port of the housing and away from the output port.

11. The materials classifier of claim 8 wherein the conveyor belt located within the housing and a motor driving the conveyor belt is located outside of the housing.

12. The materials classifier of claim 8 further comprising a blower.

13. The materials classifier of claim 8 further comprising an air deflector that directs the air flow of the air flow path.

14. The materials classifier of claim 8, wherein the conveyor belt is situated parallel to the bottom of the housing.

* * * * *